US005536184A

United States Patent [19]

Wright et al.

[11] Patent Number: 5,536,184

[45] Date of Patent: Jul. 16, 1996

[54] CONNECTOR ASSEMBLY

[75] Inventors: John O. Wright; Albert D. Skopic, both of York, Pa.

[73] Assignee: Osram Sylvania Inc., Danvers, Mass.

[21] Appl. No.: 501,191

[22] Filed: Jul. 11, 1995

[51] Int. Cl.[6] ..... H01R 9/05

[52] U.S. Cl. ..... 439/578; 439/585; 439/825

[58] Field of Search ..... 439/578, 842, 439/851, 825, 826, 818, 583–585, 821

[56] References Cited

U.S. PATENT DOCUMENTS

| | | | |
|---|---|---|---|
| 4,377,320 | 3/1983 | Lathrop et al. | 439/585 |
| 4,468,083 | 8/1984 | Lee et al. | 439/825 |
| 4,648,683 | 3/1987 | Botka | 439/821 |
| 4,666,232 | 5/1987 | Shyu | 439/578 |
| 4,990,104 | 2/1991 | Shieferly | 439/578 |
| 4,990,105 | 2/1991 | Karlovich | 439/578 |
| 5,004,438 | 4/1991 | Cabourne | 439/825 |
| 5,011,438 | 4/1991 | Awbrey | 439/825 |
| 5,123,864 | 6/1992 | Karlovich | 439/585 |

*Primary Examiner*—David L. Pirlot
*Assistant Examiner*—Brian J. Biggi
*Attorney, Agent, or Firm*—William H. McNeill

[57] ABSTRACT

A connector assembly is provided which includes an elongated metal housing which contains an electrical connector spaced from the housing by an insulator, a coaxial cable being electrically and mechanically connected to the electrical connector. The elongated metal housing includes a tapered section at one end which secures a metal shell to a metal sleeve between which a ground wire braid of the coaxial cable is sandwiched, the metal shell and metal sleeve being fastened to an end of the coaxial cable.

15 Claims, 3 Drawing Sheets

CONNECTOR ASSEMBLY

BACKGROUND OF THE INVENTION

1. Field of the Invention

The present invention relates to a connector assembly. More particularly, the present invention relates to a connector assembly for use with an antenna connector.

2. Description of the Prior Art

A typical connector for an antenna cable such as those used in the automobile industry for radios includes a male connector body generally in the form of a plug and a female connector body generally in the form of a ferrule which forms a socket. In use, the male connector body is plugged into the female connector body to effect a mechanical and electrical connection between the two. Typically, an antenna cable in the form of a coaxial cable is electrically and mechanically attached to one of the connectors such as the female connector. The other connector, such as the male connector, may also be electrically and mechanically connected to a coaxial cable or other conductor or to a circuit such as a circuit on a printed circuit board. In such prior art devices, when a male or female connector is attached to a coaxial cable such as conventional PVC coaxial cable, the cable is prepared for use by stripping one end thereof to provide a length of monofilament wire which is electrically and mechanically attached to the male or female connector. Such length of monofilament wire extends from a length of insulative covering. The length of insulative covering is free of the ground wire braid, the ground wire braid being folded back upon a metal sleeve which surrounds and is crimped to the outer PVC jacket of the coaxial cable. An outer metal shell is provided, the ground wire braid being sandwiched between the metal sleeve and metal shell. This combination is enclosed within a metal housing one function of which is to secure the brass shell to the metal sleeve. Known prior art metal housings have not satisfactorily secured the metal shell to the metal sleeve. In addition, known metal housings have not provided adequate strain relief when the coaxial cable is subject to axial pull relative to the connector to which the length of monofilament wire is connected. In such instances, there is a tendency for the connection between the coaxial cable monofilament wire and connector to loosen or to break.

DISCLOSURE OF THE INVENTION

It is an object of the present invention to provide an improved connector assembly which includes an outer metal housing which firmly secures a metal shell to a metal sleeve at the end of a coaxial cable.

It is a further object of the present invention to provide such an improved connector assembly which will provide improved strain relief to prevent degrading the connection between a coaxial cable and connector attached thereto when the coaxial cable is subjected to axial pull.

These objects are accomplished, in one aspect of the invention, by providing a connector assembly which comprises a first section and an opposite second section spaced from the first section in the direction of a lengthwise axis of the connector. A plurality of bridging members is provided which extend in the direction of the lengthwise axis from the first section to the opposite second section. Each bridging member has a portion which protrudes away from the lengthwise axis, adjacent bridging members being spaced from each other in a circumferential direction relative to the lengthwise axis. A third section is provided which is adjacent to and extends from the first section in the direction of the lengthwise axis. Such third section is tapered towards the lengthwise axis from a juncture between the first section and third section to an end of the third section.

BRIEF DESCRIPTION OF THE DRAWINGS

This invention may be clearly understood by reference to the attached drawings in which.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
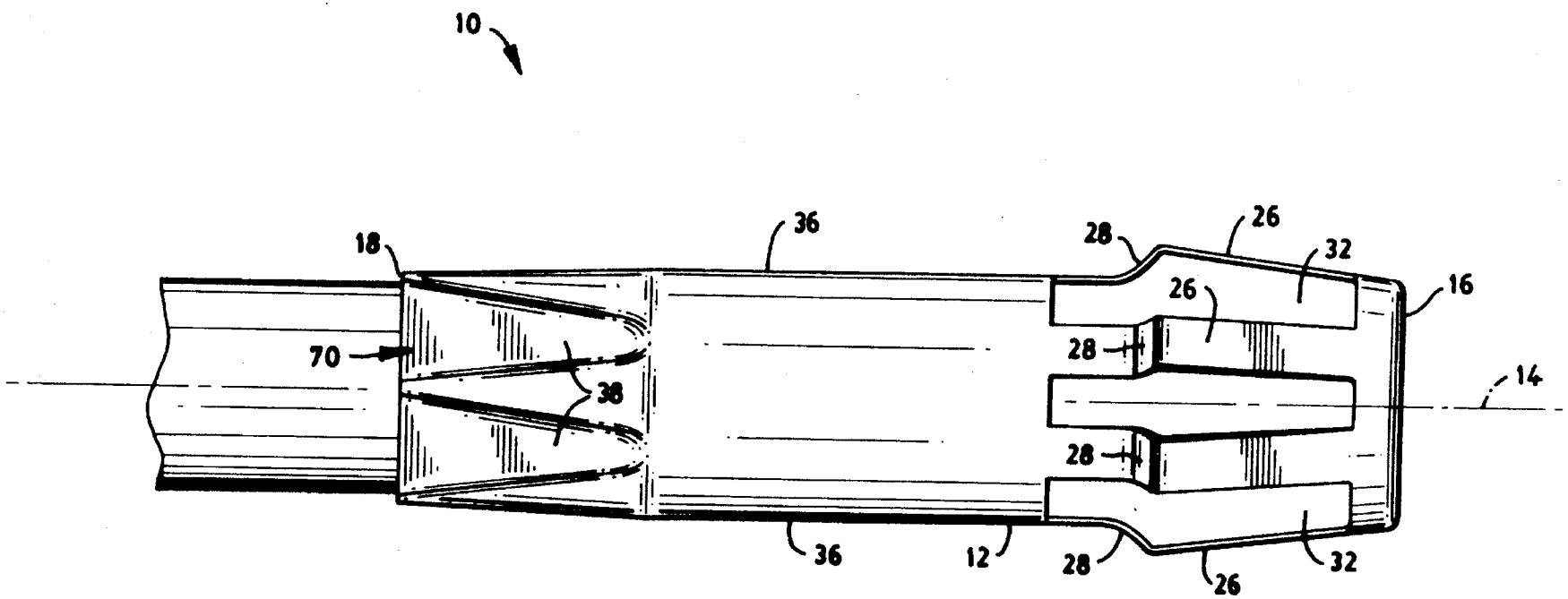
FIG. 1 is a perspective view of one embodiment of the connector assembly of the present invention.
Figure 2:
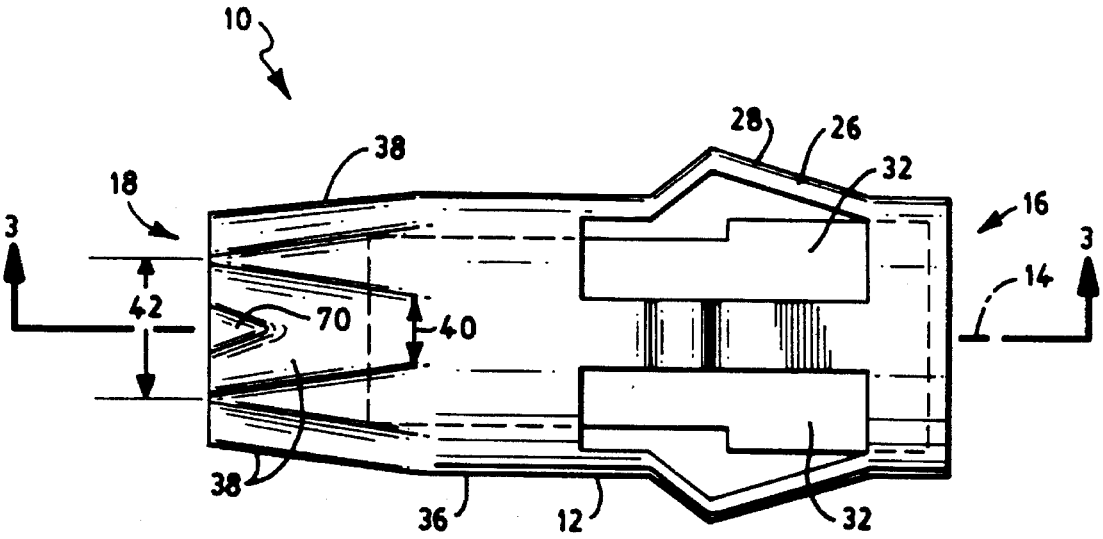
FIG. 2 is an elevational view of the embodiment of FIG. 1.
Figure 4:
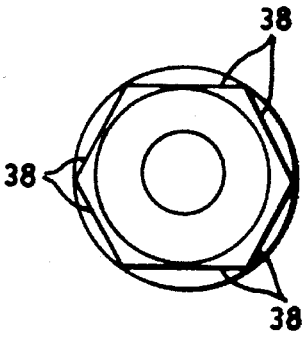
FIG. 4 is an end view of the embodiment of FIG. 1 viewed from the left.
Figure 5:
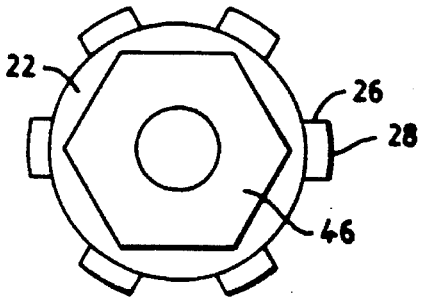
FIG. 5 is an end view of the embodiment of FIG. 1 viewed from the right.
Figure 3:
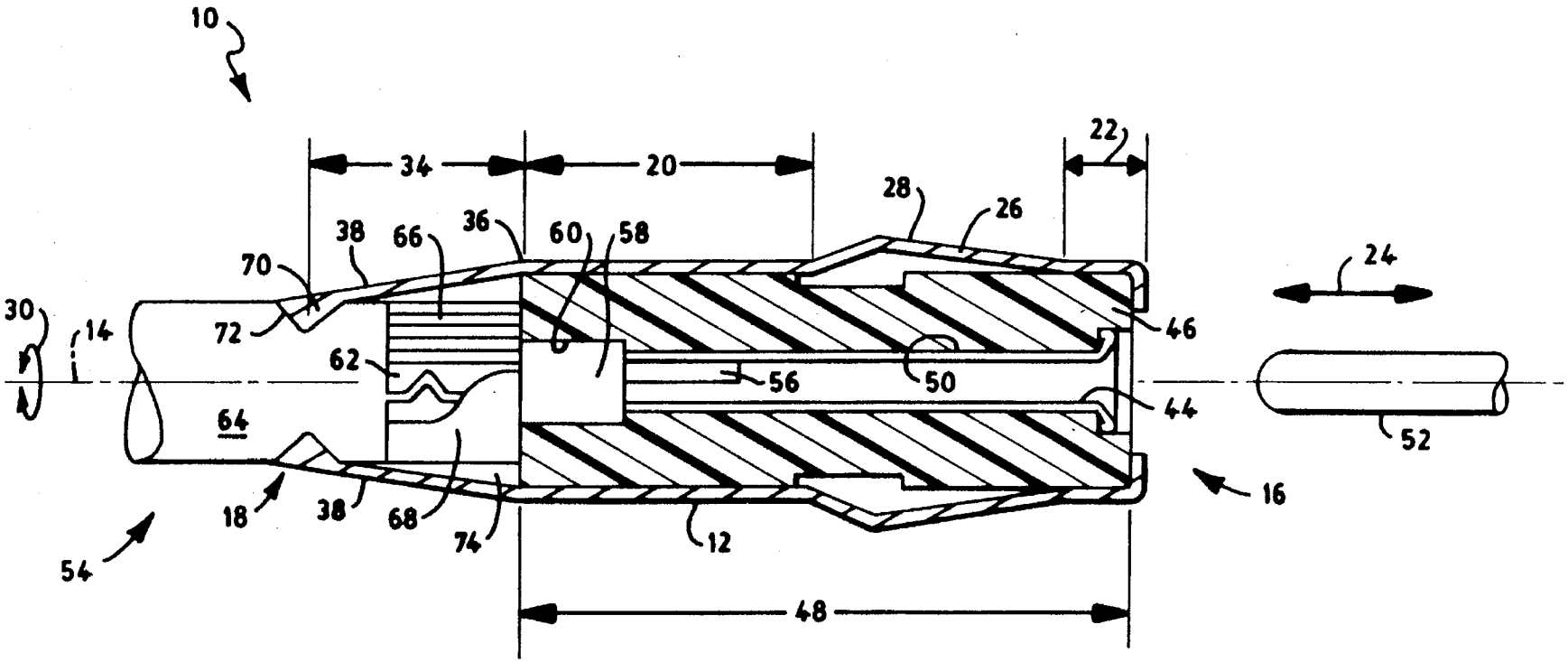
FIG. 3 is a partial sectional view of the embodiment of FIG. 1 taken along lines 3—3 of FIG. 2.

The embodiment of this invention which is illustrated in the drawings is particularly suited for achieving the objects of this invention. FIGS. 1 to 5 depict a connector assembly 10 which comprises an elongated metal body 12 which has a lengthwise axis 14. The elongated body 12 extends from an end 16 to an opposite end 18. The end 16 of the elongated body 12 is connectable to an electrical connector as described herein. Elongated body 12 comprises a tapered segment which tapers towards the lengthwise axis 14 from an intermediate portion of the elongated body to end 18 as depicted in FIGS. 1 to 3.

In the embodiment of FIGS. 1 to 5 the connector assembly 10 comprises a first section 20 and an opposite second section 22 spaced from the first section in the direction 24 of lengthwise axis 14. A plurality of bridging members 26 extend in the direction 24 from the first section 20 to the opposite second section 22. Each bridging member 26 includes a portion 28 which protrudes away from the lengthwise axis 14. Adjacent bridging members 26 are spaced from each other in a circumferential direction 30 relative to lengthwise axis 14 forming elongated openings 32 between adjacent bridging members. In the preferred embodiment, the first section 20 and second section 22 are cylindrical.

A third section 34 is provided adjacent the first section 20. The third section 34 extends from the first section 20 in the direction 24 of lengthwise axis 14. The third section 34 is tapered towards the lengthwise axis 14 from a juncture 36 between the first section 20 and third section 34 to end 18. Although in the preferred embodiment, the tapered third section 34 extends from the first section 20 to the end 18, the first section 20 can be eliminated in which case the bridging members will extend between the second section 22 and the tapered section 34.

In the preferred embodiment, the third section has a truncated cone-like configuration which tapers towards the lengthwise axis of the connector. In particular, the third section will be configured like a truncated cone, the cone surface comprising flat surfaces which extend from one end towards the other. For example, in the embodiment of FIGS. 1 to 5, the third section comprises a plurality of flat surfaces 38 each of which extend in the direction 24 of the lengthwise axis 14 and taper towards such axis from juncture 36 to end 18. Each flat surface 38 extends from an apex portion having a width 40 adjacent the juncture 36 to a base portion having a width 42 at end 18. The width 42 of the base portion is greater than the width 40 of the apex portion. In the embodiment of FIGS. 1 to 5 there are six flat surfaces which form a truncated hexagonal cone-like configuration.

The connector of the present invention comprises a metal electrical connector which may be electrically and mechanically connected to another electrical connector in use. For example, in the embodiment of FIGS. 1 to 5, the connector assembly 10 includes a metal connector 44 positioned within a plastic insulator 46 which is positioned within the first section 20 and second section 22 and has a length 48 which extends in the direction 24 of lengthwise axis 14 from end 16 to juncture 36.

The insulator 46 is generally tubular having a bore 50 in which the metal connector 44 is positioned as depicted in FIG. 3. The metal electrical connector 44 may be a conventional metal ferrule which provides a female connector which may be electrically and mechanically connected to a mating male connector 52 in the usual manner when in use. The connector 44 extends in the direction 24 of lengthwise axis 14 from end 16 towards juncture 36. In an alternative embodiment not depicted in the drawings, the male and female connectors may be reversed in which case the male connector 52 will replace the female connector 44 within the plastic insulator 46 for electrical and mechanical connection to a mating female connector.

In the embodiment of FIGS. 1 to 5, a conductor 54 extends into the tapered third section 34 at end 18 and is mechanically and electrically connected to the female metal connector 44. Another conductor (not shown) may be mechanically and electrically connected to the male metal connector 52 in a conventional manner. In the preferred embodiment, conductor 54 is a coaxial cable comprising a segment 56 of monofilament metal wire which is mechanically and electrically connected to the female metal connector 44 by soldering in a conventional manner. The coaxial cable includes a segment 58 of insulative covering which is free of ground wire. The segment 58 extends into a bore 60 of the insulator 46 at end 18, the segment 56 extending from the segment 58 for attachment to the female metal connector 44.

In the embodiment of FIGS. 1 to 5 a metal sleeve 62 is crimped to an outer peripheral PVC surface 64 of the coaxial cable adjacent the segment 58 of insulative covering. A ground wire braid portion 66 of the coaxial cable is folded back upon the metal sleeve 62. A metal shell 68 adjacent the segment 58 is also provided, the ground wire braid portion 66 being sandwiched between the metal sleeve 62 and the metal shell 68. The tapered third section 34 is crimped to the coaxial cable. In the preferred embodiment at least two flat surfaces 38 will be crimped to the coaxial cable. In the embodiment of FIGS. 1 to 5, two opposite flat surfaces 38 are crimped at 70, the two flat surfaces being deformed adjacent end 18 to bear against and deform the outer surface 64 of the coaxial cable at 72 without engaging the sleeve 62 or shell 68. In such embodiment, the tapered third section 34 will be spaced from the coaxial cable at 74 as depicted in FIG. 3.

The connector housing of the connector assembly described herein firmly secures the metal shell 68 to the metal sleeve 62 with the ground wire braid 66 sandwiched therebetween. At the same time, strain relief is provided to prevent degradation of the connection between the monofilament wire 56 of the coaxial cable and the connector 44. In fact, by providing crimps 70 at the end of one or more flat surfaces 38 of a tapered section having the truncated hexagonal cone-like configuration of FIGS. 1 to 5, a substantial increase in resistance to axial pull of the coaxial cable is provided relative to prior art devices.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A connector assembly, comprising:

a first section and an opposite second section spaced from said first section in the direction of a lengthwise axis of said connector assembly, and a plurality of bridging members which extend in the direction of said lengthwise axis from said first section to said opposite second section, each bridging member of said plurality of bridging members having a portion which protrudes away from said lengthwise axis, adjacent bridging members of said plurality of bridging members being spaced from each other in a circumferential direction relative to said lengthwise axis; and a third section adjacent to and extending from said first section in the direction of said lengthwise axis and being tapered towards said lengthwise axis from a juncture between said first section and said third section to an end of said third section, said third section comprising a plurality of flat surfaces each of which extend in the direction of said lengthwise axis and taper towards said lengthwise axis from said juncture to said end of said third section, each of said flat surfaces of said plurality of flat surfaces extending from an apex portion adjacent said juncture to a base portion at said end of said third section, said base portion being wider than said apex portion.

2. The connector assembly of claim 1 further including an insulator positioned within said first and second section and having a length which extends in the direction of said lengthwise axis from an end of said second section to said juncture.

3. The connector assembly of claim 2 further including a metal connector positioned within said insulator and extending in the direction of said lengthwise axis from said end of said second section towards said juncture.

4. The connector assembly of claim 3 further including a conductor extending into said third section at said end of said third section, said conductor being mechanically and electrically connected to said metal connector.

5. The connector assembly of claim 4 wherein said conductor comprises a coaxial cable comprising a length of metal wire mechanically and electrically connected to said metal connector, said end of said third section being crimped to an outer surface of said coaxial cable.

6. The connector assembly of claim 5 wherein said third section is spaced from said coaxial cable at said juncture.

7. The connector assembly of claim 1 wherein said first section and said second section are each cylindrical.

8. The connector assembly of claim 7 wherein said plurality of flat surfaces comprises six flat surfaces, said third section having a truncated hexagonal cone-like configuration.

9. The connector assembly of claim 1 further including an insulator positioned within said first and second section and having a length which extends in the direction of said lengthwise axis from an end of said second section to said juncture.

10. The connector assembly of claim 9 further including a metal connector positioned within said insulator and extending in the direction of said lengthwise axis from said end of said second section towards said juncture.

11. The connector assembly of claim 10 further including a conductor extending into said third section at said end of said third section, said conductor being mechanically and electrically connected to said metal connector.

12. The connector assembly of claim 11 wherein said conductor comprises a coaxial cable comprising a length of metal wire mechanically and electrically connected to said metal connector, said end of said third section being crimped to an outer surface of said coaxial cable.

13. The connector assembly of claim 12 wherein at least two flat surfaces of said plurality of flat surfaces are crimped to said coaxial cable adjacent a respective base portion.

14. The connector assembly of claim 5 wherein said coaxial cable comprises a length of insulative covering free of ground wire, said length of insulative covering extending into said insulator, and said length of metal wire extending from said length of insulative covering.

15. The connector assembly of claim 14 including a metal sleeve attached to an outer peripheral surface of said coaxial cable adjacent said length of insulative covering, a ground wire portion of said coaxial cable being folded back upon said metal sleeve, and further including a metal shell adjacent said length of insulative covering, said ground wire portion being sandwiched between said metal sleeve and said metal shell.

* * * * *